US005606986A

United States Patent [19]

Muise

[11] Patent Number: 5,606,986

[45] Date of Patent: Mar. 4, 1997

[54] CLEAR TOP INSIDE VEIL TENT

[76] Inventor: Eric M. Muise, 410 Center St., Pembroke, Mass. 02359

[21] Appl. No.: 377,100

[22] Filed: Jan. 23, 1995

[51] Int. Cl.[6] ..... A45F 1/16

[52] U.S. Cl. ..... 135/87; 135/97; 135/91; 135/115; 135/117; 135/119

[58] Field of Search ..... 135/87, 97, 115, 135/117, 119, 120.1, 94, 91, 96

[56] References Cited

U.S. PATENT DOCUMENTS

| | | | |
|---|---|---|---|
| 2,193,469 | 3/1940 | Ashton | 135/115 X |
| 3,028,872 | 4/1962 | Cresswell | 135/115 X |
| 3,848,279 | 11/1974 | Ipsen, Jr. | 135/117 X |
| 3,863,660 | 2/1975 | Glaeser | 135/115 X |
| 4,236,543 | 12/1980 | Moss | 135/94 |
| 4,519,410 | 5/1985 | Kubacki | 135/97 X |
| 4,709,718 | 1/1987 | Nichols | 135/115 X |
| 4,719,935 | 1/1988 | Gustafson | 135/94 X |
| 4,819,389 | 4/1989 | Kihn | 135/97 X |
| 4,858,635 | 8/1989 | Eppenbach | 135/117 X |
| 5,240,021 | 8/1993 | Snodgrass | 135/96 |

*Primary Examiner*—Wynn E. Wood

[57] ABSTRACT

A tent having a ceiling comprised of a fixed permanent piece of clear flexible plastic material, The tent has a veil which shields or unshields the ceiling of the tent, the veil which when attached to the ceiling protects the interior from excessive heat, direct sunlight or an unencumbered view, or when removed permits an excellent celestial view, The veil functions from within the tents' interior structure. The veil spreads only across the interior surface Of the ceiling of the tent, connecting the outer peripheral edges of the veil to the interior edges of the ceiling, with VELCRO as a means of fastening. This benefit of being able to unshield, or shield the ceiling of the tent from within the interior of the tent structure gives great conveniences, such as privacy, comfort, security, and safety from inclement weather conditions and neighbors.

8 Claims, 1 Drawing Sheet

CLEAR TOP INSIDE VEIL TENT

BACKGROUND OF THE INVENTION

1. Field of the Invention

The present invention gives the privacy, comfort, security, convenience, and safety that people would like to have when utilizing a tent with a clear ceiling.

2. Description of the Prior Art

While some have incorporated canvas or nylon flaps over windows or doors conventionally known to the art, these served with limited benefits. These flaps over the windows or doors did not permit the uninhibited viewing of the sky when desired; nor allow relief from the direct sun after receiving a realisticaly great suntan. The usefulness of the veil is improved due to the placement of the veil. Still while some tents have been provided with transparent or netted roofs, no prior art tents have been provided with a novel method of using a veil that could shield or unshield a clear plastic ceiling of a tent while remaining inside the interior of the tents' embodiment; eliminating the need of having to exit from the tents' protection to execute options.

A portable multi-purpose tent assembly, was issued to Stephen R. Gustafson on Jan. 19, 1988 U.S. Pat. No. 4,719,935. This method of by which Gustafson teaches for the application of his roof sections, is one of being which does not apply the roof sections from within the inside of the tent embodiment, but rather his teaches in accordance with (col.3, lines 25–30) and (col.5, line 68-col.6, lines 1–7). His design requires that you should first exit from the tent embodiment and then uncover or remove the roof section and then cover the opening with another section. Beyond it all the apparatus is much more like a sleeping bag which is much to small and confining to climb into with a roof covering and try to replace it from within the apparatuss' interior structure.

French Pat. No. 1,297,389 to Maurer, and U.S. Pat. No. 4,236,543 to Moss both provided tents with areas in the roof which permitted viewing of the sky. Yet neither taught a means for shielding the roof while remaining inside the tent structure. The desires of the user and the like.

Lastly U.S. Pat. No. 3,028,872 issued to H. W. Cresswell Apr. 10, 1962 provided a transparent plastic roof on greenhouses, yet never incorporated any kind of protective layer to shield the interior, for whatever reasons. Also this invention pertains more towards a shelter for vegation and is not really a tent in the true camping sense.

SUMMARY OF THE INVENTION

It is therefore the object of the present invention to provide a convenient method for unshielding or shielding a clear ceiling on a tent without having to leave the tents' interior like when one, might be in one's undergarments and does not wish to get all dressed up to go alter the tents' ceiling condition, especially during inclement weather.

It is therefore another object of the present invention to provide a safe method for unshielding, or shielding the clear plastic ceiling on a tent without having to risk exposure to inclement weather, such exposure can easily incur certain illnesses which when camping can be quite hazardous.

It is still another object of the invention to reserve privacy for the occupants of the tent, as to eliminate the need of having to go outside the surrounding walls of the tent to obtain a change.

It is a further object of the invention to provide the comfort of not having to get up, and go outside the tents' protection, (especially when one is all cozy and warm) just to make alterations.

DETAILED DESCRIPTION OF THE DRAWINGS

Figure 1:
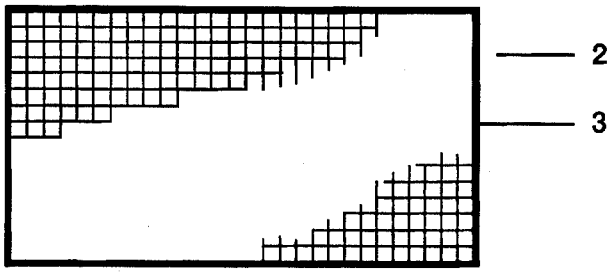
FIG. 1 is a perspective view of the Inside Veil of the present invention.

FIG. 1 is a perspective view illustrating the veil 2, made of conventional tent like material, such as nylon or canvas. One relatively thin strip of velcro 3, is lined along each one of the outer peripheral edges of the veil 2.

Figure 2:
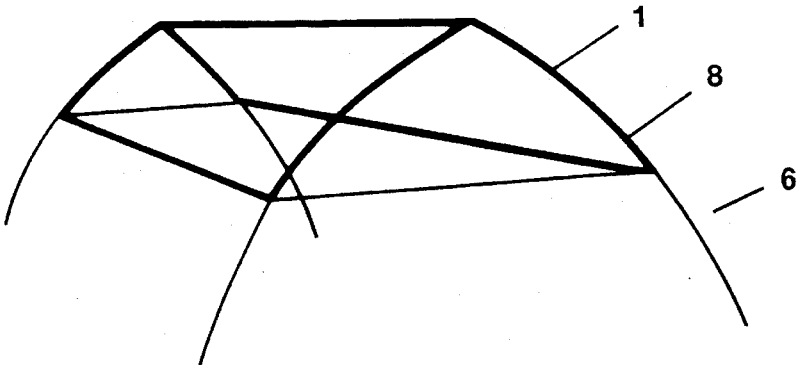
FIG. 2 is a perspective view of the tents' embodiment, highlighting the outer edges oft he clear plastic ceiling of the tents' embodiment.

FIG. 2 is a perspective view of a tent 6 having sidewalls 8 comprising a transparent upper portion defining a clear plastic ceiling 1.

Figure 3:
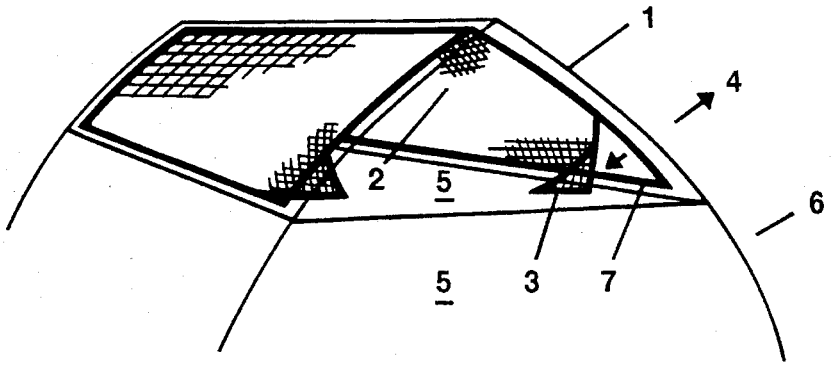
FIG. 3 is a semi cross sectional view of the tents' embodiment, and ceiling portion of FIG. 2 #1. Illustrating how the Inside Veil of the present invention attaches and detaches.

FIG. 3 is a semi cross sectional view of the tent 6. Illustrating the ceiling portion of FIG. 2 #1 with the veil 2, partially fixed in place and partially pealled away, allowing the visibility shown by 4. The veil 2 complementarily fastens by the means of attaching the velcro 3 to the velcro 7 lined along the interior edges of the ceiling 1. The only one front sidewall 5 of the tents' embodiment is symmetrical to the non-abutting rear sidewall. Both sidewalls extent to the apex of the ceiling 1, and are opaque.

What I claim is:

1. A tent:

a) said tent having an inner portion, an outer portion, and sidewalls, said inner portion defining an inner space, said sidewalls having a transparent upper portion defining a ceiling, said transparent upper portion having an inner and outer surface defined by a peripheral edge; and b) a veil removably attached to said inner surface of said transparent upper portion at said peripheral edge.

2. The tent of claim 1, wherein said ceiling is made of a plastic material which can easily and substantially be looked through; whereby permitting the environs which borders the said outer portion of the said tent to be easily and substantially observed from and while remaining within said inside space.

3. The tent of claim 1, wherein said veil when attached to said inner surface of said transparent upper portion does not permit the ceiling to be easily and substantially looked through.

4. The tent of claim 1, wherein the said veil may be partially detached or attached to said inner surface of said transparent upper portion, permitting the environs which borders the outer portion of the said tent to be partially seen, or not seen.

5. The tent of claim 1, wherein said veil is made of any conventional tent-like material known to the art; such as canvas, nylon, cotton, polyester, and rayon.

6. The tent of claim 1, wherein said veil is substantially opaque.

7. The tent of claim 1, wherein said veil is made of substantially nonpermeable material.

8. The tent of claim 1, wherein said veil may be fastened to said inner peripheral edge of said inner surface of said transparent upper portion by any conventional method or material known to the art.

* * * * *